US006276374B1

(12) United States Patent
Wilson

(10) Patent No.: US 6,276,374 B1
(45) Date of Patent: Aug. 21, 2001

(54) ROTARY STYLE PARTS CLEANING MACHINE WITH A POCKETED WHEEL

(75) Inventor: Karle M. Wilson, West Chester, OH (US)

(73) Assignee: CAE Ransohoff Inc., Cincinnati, OH (US)

( * ) Notice: Subject to any disclaimer, the term of this patent is extended or adjusted under 35 U.S.C. 154(b) by 0 days.

(21) Appl. No.: 09/491,056

(22) Filed: Jan. 25, 2000

(51) Int. Cl.[7] ..... B08B 3/02
(52) U.S. Cl. ..... 134/80; 134/142; 134/153
(58) Field of Search ..... 134/79, 80, 81, 134/140, 142, 153, 158, 161, 162

(56) References Cited

U.S. PATENT DOCUMENTS

| | | | | |
|---|---|---|---|---|
| 97,688 | * | 12/1869 | Pfeiffer | 134/142 |
| 2,078,699 | * | 4/1937 | Taylor et al. | 134/81 |
| 2,823,682 | | 2/1958 | Coulter | 134/94 |
| 3,096,774 | | 7/1963 | Rand | 134/79 |
| 3,153,419 | | 10/1964 | Evans et al. | 134/133 |
| 3,192,935 | | 7/1965 | Hanifan | 134/142 |
| 3,240,216 | | 3/1966 | Sadwith | 134/80 |
| 3,645,791 | | 2/1972 | Sadwith | 134/25 A |
| 3,691,691 | | 9/1972 | Smith | 51/15 |
| 3,952,756 | | 4/1976 | Sheppard | 134/133 |
| 4,084,357 | | 4/1978 | Moses | 51/419 |
| 4,174,722 | | 11/1979 | Fleenor et al. | 134/62 |
| 4,215,928 | * | 8/1980 | Bayley et al. | 134/80 X |
| 4,516,523 | | 5/1985 | Knox | 118/500 |
| 4,577,441 | | 3/1986 | Brenner | 51/419 |
| 4,662,125 | | 5/1987 | Brenner et al. | 51/419 |
| 5,029,595 | | 7/1991 | Hautau | 134/142 |
| 5,197,500 | | 3/1993 | Diamond | 134/142 |
| 5,368,053 | | 11/1994 | Wilson | 134/95.2 |
| 5,653,247 | * | 8/1997 | Murakami | 134/80 |
| 5,666,985 | | 9/1997 | Smith, Jr. et al. | 134/142 |
| 5,951,763 | | 9/1999 | Knox | 118/409 |

FOREIGN PATENT DOCUMENTS

| | | | | |
|---|---|---|---|---|
| 683818 | * | 9/1979 | (SU) | 134/140 |

* cited by examiner

*Primary Examiner*—Philip R. Coe
(74) *Attorney, Agent, or Firm*—Olson & Hierl, Ltd.

(57) ABSTRACT

A parts cleaning machine comprises a housing having a wheel with a fixture journalled for rotation thereon. The wheel comprises one or more pockets within which the fixtures may rotate. Drive mechanism comprising a wheel drive for indexing the wheel and a fixture drive for rotating the fixture at a predetermined location or locations during indexing of the wheel is provided in the housing. The wheel drive is actuated by a motor and a gear reducer operatively connected to the pocketed wheel. The fixture drive is actuated by a motor and an endless belt, or the like, is operatively connected to a drive gear on a shaft extending upwardly from the fixture. The wheel may be moved from a load station to a wash station, where spray nozzles may spray wash liquid onto the parts to be cleaned as they are rotated in the fixture at the wash station. Then the wheel is indexed to move the fixture to a blow-off station, where blow-off nozzles can blow air against the cleaned parts to remove wash liquid and dry the cleaned parts. Thereafter, the wheel is indexed to return the fixture to the load station, where the cleaned parts can be removed from the fixture and parts to be cleaned can be placed into the fixture to begin the next cycle of operation. Optionally, a rinse station can be included in the housing, where a rinse liquid can be sprayed onto the cleaned parts between the wash station and the blow-off station.

22 Claims, 3 Drawing Sheets

ROTARY STYLE PARTS CLEANING MACHINE WITH A POCKETED WHEEL

FIELD OF THE INVENTION

This invention relates generally to a parts cleaning machine, and more particularly to a compact, multi-stage, rotary style parts cleaning machine having a pocketed wheel rotatable about a generally vertical wheel axis and a rotatable fixture in at least one pocket rotatable about a generally vertical fixture axis at a predetermined rotary position of the pocketed wheel.

BACKGROUND OF THE INVENTION

Various types of parts cleaning machines are known in the trade. One type of parts cleaning machine is known that includes a reservoir with two tanks, one containing wash solution and the other containing rinse solution. The basket is movable between a loading position, a cleaning position, and a rinse position. When the basket is in the cleaning position inside the reservoir, it is alternately rotated in opposite directions. An example of this type of parts cleaning machine is found in U.S. Pat. No. 5,368,053 to Wilson.

Another type of parts cleaning machine, as shown for example, in U.S. Pat. No. 3,645,791 to Sadwith, includes a platform rotatable in a housing, with parts to be cleaned supported on the platform and with a plurality of nozzles positioned in the housing for spraying streams of water on the articles to produce a scrubbing, scouring, or lifting effect on dirt and foreign matter present on the articles being washed. Since the parts to be cleaned are stationary on the platform, cleaning of irregular shaped parts is sometimes difficult and a relatively large number of spray nozzles and a relatively large volume of cleaning solution or wash solution is need to try to reach and clean all surfaces of the parts to be cleaned.

U.S. Pat. No. 5,197,500 to Diamond discloses a combustion chamber cleaning machine including a revolvable main turntable having a plurality of individual minor turntables for supporting the combustion cylinders and rotating them. The drives and controls for the main turntable and the minor turntables are relatively complex and costly.

In U.S. Pat. No. 5,666,985 to Smith, there is shown a programmable apparatus for cleaning semiconductor parts which includes a chuck mounted on a rotation mechanism rotatable around a first axis and the element to be cleaned rotates around a second axis spaced from the first axis in a planetary member. The drives for the main turntable and the minor turntables are subject to contamination because of their location in the cleaning chamber.

It is known in multi-stage rotary washers to transfer parts along a circular path. After a part is loaded in the housing of the rotary washer, the transfer mechanism indexes the part into the first station of the rotary washer. Each successive index transports the part to the next station. Eventually, after passing through each of the processing stages, the washed part reaches the unload station, where it is removed from the rotary washer. The transfer mechanism rotates about a single axis. Because of this, liquid solution spray nozzles and air blow-off nozzles, which are used to clean, rinse and dry, respectively, have to be positioned in numerous locations throughout the processing stages. Numerous nozzles are needed to assure that wash and rinse solution and air impinge upon critical surfaces multiple times, for cleaning and drying of the parts.

The known multi-stage rotary washers have several drawbacks, however. The equipment footprint is large, that is, the rotary washer occupies considerable floor space, and the equipment itself is relatively complex. Thus, there exists a need for an improved multi-stage rotary washer for cleaning parts which is relatively compact and obviates deficiencies and disadvantages of prior art rotary washers.

Other objects and advantages of the present invention will be made more apparent in the description which follows.

SUMMARY OF THE INVENTION

In one aspect, this invention pertains to a parts cleaning machine comprising a housing defining a cleaning chamber having an inlet opening. Disposed in the housing is a wash media source, e.g., a tank containing wash solution. A pocketed wheel having one or more pockets defined therein is positioned in the cleaning chamber defined by the housing for rotation about a generally vertical wheel axis. At least one fixture for supporting a part or parts to be cleaned is rotatably carried on the pocketed wheel within one of the pockets for rotation about a generally vertical fixture axis spaced from the generally vertical wheel axis. A pocketed wheel drive, preferably located above the wheel, is provided for rotating the wheel. A separate fixture drive is provided for intermittently rotating the fixture while at a predetermined location or locations to which the fixture has been transported by rotation of the wheel. The pocketed wheel drive and the fixture drive can be actuated by the same motor, or each drive can be provided with a separate motor, as desired. Spray nozzles are provided in the housing in communication with a wash media source, such as, a tank containing a wash liquid or rinse liquid for the parts. A drying gas source, such as a blower is operatively associated with blow-off nozzles in the housing for drying the washed parts. Controls are provided for controlling actuation of the pocketed wheel drive and the fixture drive. Preferably, the fixture comprises a foraminous or wire mesh basket for holding parts.

BRIEF DESCRIPTION OF THE DRAWINGS

The attached accompanying drawings illustrate a presently preferred embodiment of the present invention. In the drawings, like numerals in the various views refer to like elements.

DESCRIPTION OF THE PREFERRED EMBODIMENT

Figure 1:
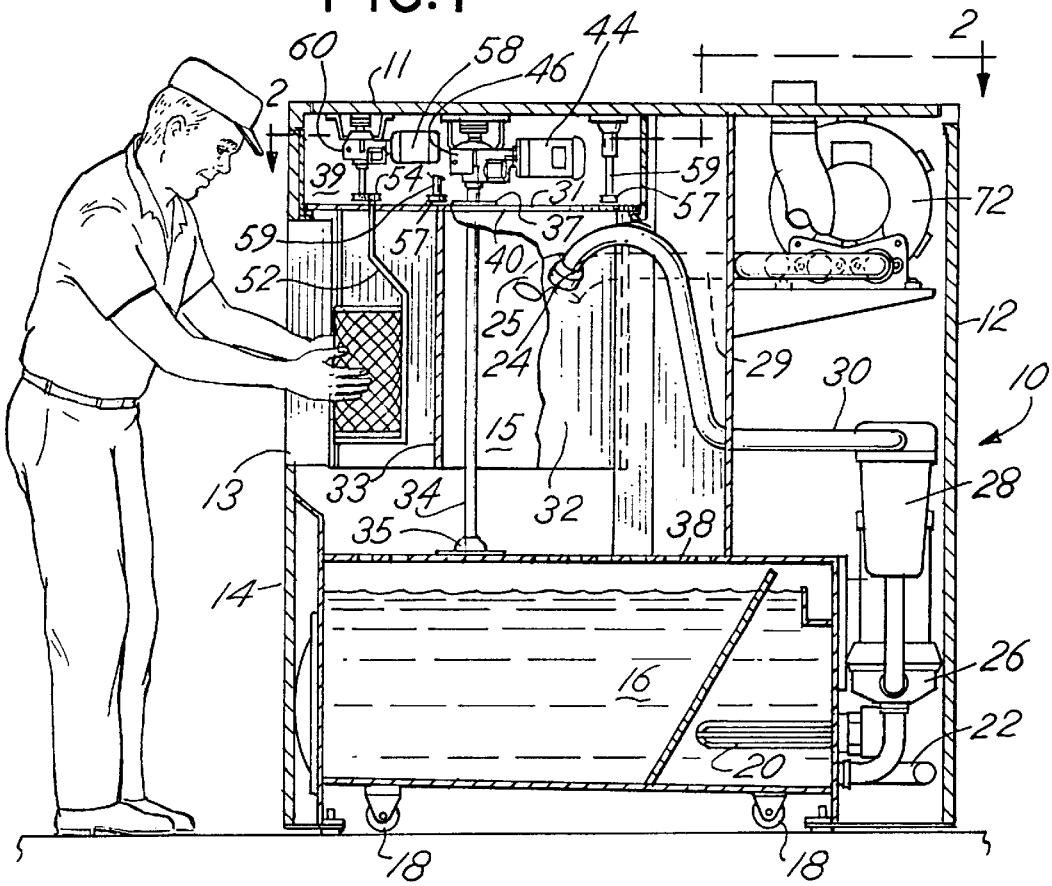
FIG. 1 is an elevation view, partly in section, of the parts cleaning machine of the present invention.
Figure 2:
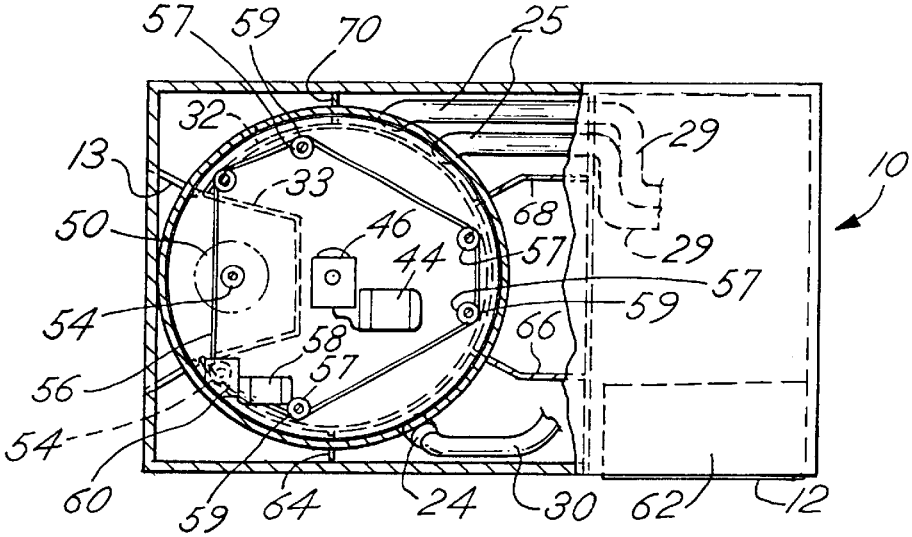
FIG. 2 is a plan view of the parts cleaning machine, taken along plane 2—2 in FIG. 1, to show interior components.

FIGS. 1 and 2 show a parts cleaning machine 10 of the present invention. The parts cleaning machine 10 comprises a housing 12 which defines a cleaning chamber and contains the operating components. For ease of moving, casters or wheels 18 can be provided for cleaning machine 10. Positioned in the bottom of the housing 12 and accessible through an access door 14 in the housing 12 is a holding tank 16 for a wash liquid which serves as a wash media source in fluid flow communication with a wash station or stations. In order to heat the wash liquid to a desired temperature, a heater 20 is provided. The wash liquid holding tank 16 is provided with a drain 22. An optional rinse liquid holding tank, similar to tank 16, can be provided as well if it is desired to rinse the washed parts.

Spray nozzles 24 at a wash station in the housing 12 are operatively connected in fluid flow communication to the tank 16 via pump 26, filter 28 and conduit 30. At the rear of machine 10, the housing 12 is provided with a hinged access door to facilitate cleaning or change of the filter 28.

A pocketed wheel 32 having a top plate 31 and downwardly depending walls that define a single pocket 33 is positioned in the housing 12. The pocketed wheel 32 is carried on shaft 34 journalled in housing 12 for rotation about a generally vertical wheel axis. The pocketed wheel 32 is accessible through the inlet opening 13 in the front of the housing 12. The shaft 34 is carried in a bearing 35 at its lower end on support 38 in housing 12. At its upper end, the shaft 34 is journalled in a bearing 37 on top plate 31 of the pocketed wheel 32. The pocketed wheel 32 is actuated by a drive motor 44 connected to a drive gear on the shaft 34 via a gear reducer 46. Various types of motors, e.g., electric, hydraulic, pneumatic, and the like, can be utilized as drive motors, as desired. The top plate 31 together with the housing 12 define a drive compartment 39. The drive motor 44 is located in drive compartment 39 and is thus protected from the liquids and contaminants that may be present in the fixture compartment 15 below the drive mechanism. The top plate 31 is rotatable together with the pocketed wheel 32 and can be a part thereof. The drive motor 44 for the pocketed wheel drive and the drive motor 58 for the fixture drive are both in drive compartment 39 and mounted to the plate 11 of the housing 12. If desired, the pocket wheel drive and the fixture drive can be actuated by the same motor.

Rotatably carried on the pocketed wheel 32 within the pocket 33 is a fixture 50, which in the shown embodiment is a wire mesh or foraminous basket for holding parts to be cleaned. The fixture 50 is carried by the top plate 31 of the pocketed wheel 32 in the pocket 33 and is mounted for rotation about a generally vertical fixture axis, which is offset or spaced from but substantially parallel to the generally vertical wheel axis of the pocketed wheel 32. The fixture 50 is transported by the pocketed wheel 32 from the loading station shown in FIG. 2 to a wash station proximate to the spray nozzles 24 and then to a blow-off position proximate the blow-off nozzles 25.

At the wash station, the fixture 50 is rotated by the fixture drive about its generally vertical fixture axis in order to facilitate the cleaning of the parts in the foraminous basket. To that end, the fixture 50 includes a shaft 52 which is driven rotatably by the fixture drive which includes a drive gear 54 on the shaft 52, an endless drive chain, band, or belt 56 which is adapted to engage the drive gear 54, and drive motor 58 operably associated with the drive gear 54 on the shaft 52 via a gear reducer 60. As seen in the embodiment of FIG. 2, fixture 50 is at the loading station, the associated gear 54 is not engaged with belt 56, but the belt 56 is trained over five idler gears 57 carried on shafts 59 depending from and secured to the top 11 of housing 12 in order to desirably position the belt 56. When fixture 50 is transported from the loading station to a wash station, the belt 56 engages the drive gear 54 associated with drive motor 58 and gear reducer 60 and rotates the fixture.

At a blow-off station, the fixture 50 is rotated to facilitate removal of the wash liquid from the washed parts while the parts are situated in the path of a drying gas stream, such as an air stream.

Within a control panel 62 are suitable controls for controlling the pocketed wheel drive so as to move or index the pocketed wheel 32 from station to station and for controlling the fixture drive to rotate the fixture within the cell or pocket 33 in the wheel 32.

Partitions 64, 66, 68, and 70 are provided in the housing 12 in order to divide the interior of the housing 12 into operating zones or stations where various cleaning activities take place. The partitions 64 and 66 define the wash station, where the washing of the parts takes place. Partitions 68 and 70 define a blow-off station where liquid is removed from the cleaned parts and drying may occur. A drying gas source, such as the blower fan 72 in the housing 12, is operatively connected to the blow-off nozzles 25 in the blow-off station via suitable conduit 29 in the housing 12. A drying gas, e.g., air from the blower fan 72, is discharged under pressure from the nozzles 25 and force liquid from the surfaces of the cleaned parts and to aid in drying the cleaned parts. Other treatment stations can be provided as well, for example, for applying a corrosion inhibitor onto the cleaned parts.

As can be seen in FIG. 2, the fixture 50 is accessible through the inlet opening 13. The embodiment of FIGS. 1 and 2 includes only one fixture 50 on the pocketed wheel 32. At the load position, the drive gear 54 on the shaft 52 is not engaged with the endless belt 56. Hence, the fixture 50 is not rotated about its axis at the load station, but is stationary to facilitate the loading of parts to be cleaned into the foraminous basket. Pocketed wheel 32 is actuated by the pocketed wheel drive and the fixture 50 is moved to a preselected position proximate the spray nozzles 24, e.g., a wash station between partitions 64 and 66. At this location or station, the drive gear 54, which may be a spur gear, is engaged with the endless belt 56, driven by the fixture drive, and rotates the fixture about the fixture axis. The drive gear 54 is also operatively connected to the endless band or belt 56 while the fixture 50 is in the blow-off station, hence, the fixture 50 will be rotating while in the blow-off station.

Because the parts to be cleaned are rotating within the confines of a pocket 33 of the pocketed wheel 32, the number of spray nozzles 24 and blow off nozzles 25 can be reduced significantly. Contamination of parts in adjacent pockets is avoided as well. It will be understood, however, that though a single spray nozzle 24 and a pair of blow-off nozzles 25 are shown in FIG. 2, each of these nozzles may be replaced by a nozzle array suitably arranged to maximize the spray of solution and air, respectively. The unique arrangement of the present invention has considerable impact upon the resulting parts cleaning machine, namely, the pumps for liquid solution and the blower fan for air can be smaller, thereby reducing horsepower requirements and kilowatt usage, and the liquid tanks or reservoirs can be smaller, reducing the overall footprint or floor space required. The net effect is a compact parts cleaning machine with appreciably reduced operating costs. Overall, the parts cleaning machine with a pocketed wheel and the drive mechanism of the present invention affords a considerable advantage over existing parts cleaning equipment.

Figure 3:
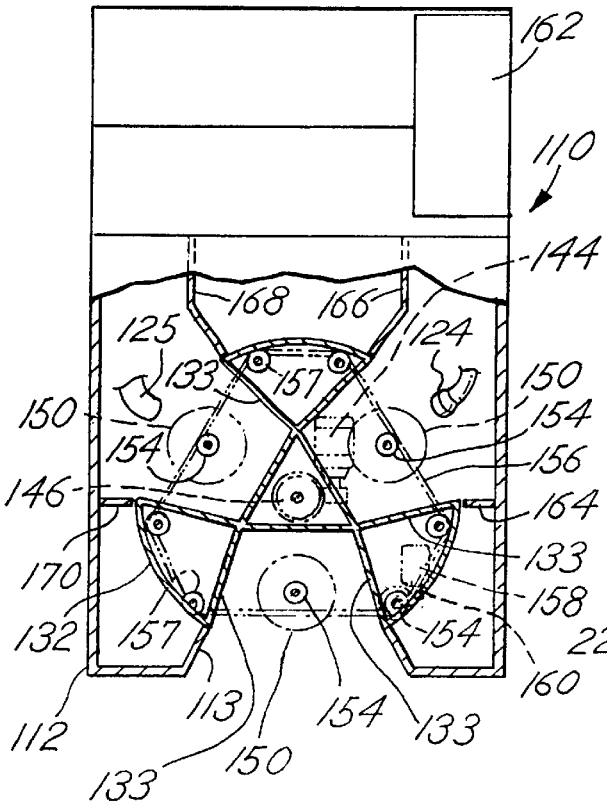
FIG. 3 is a schematic plan view of a parts cleaning machine, similar to FIG. 2, but illustrating an embodiment of a parts cleaning machine having a pocketed wheel carrying three fixtures.

Turning to FIG. 3, there is shown a modified parts cleaning machine 100 that includes a pocketed wheel 132 with three pockets 133, and having a fixture 150 in each pocket. The housing 112 is constructed and arranged basically in the same manner as the housing 12. The modified parts cleaning machine 100 operates much the same as the parts cleaning machine 10, except that capacity is increased through the use of three fixtures rather than one, each situated in a separate pocket of the pocketed wheel.

The drive mechanism for the machine 100 is substantially the same as that previously described, except that five idler gears 157 are employed. The spur drive gears 154 on the fixtures 150 are engaged with the endless chain, band, or belt 156 at the wash and the blow-off stations, so as to rotate the fixtures 150 when positioned at these locations. The spur drive gear 154 is disengaged from the chain 156 when the pocketed wheel 132 is indexed with a fixture 150 at the loading station. Hence, the fixture 150 at the loading station will not be rotated. The spur drive gear 154 can also be disengaged while the pocketed wheel 132 is indexed from station to station.

Initially, parts to be cleaned can be loaded into the fixture 150 in the pocket 133 of the wheel 132 aligned with the inlet opening 113. The fixture 150 at the load station is not rotating since the spur drive gear 154 at the upper end thereof is disengaged from the belt 156. The controls in the control panel 162 are operated to actuate the first drive means comprising drive motor 144 and index the wheel 132 from the load station to the wash station. At the wash station the spur drive gear 154 on the fixture 150 is engaged with the belt 156, which is driven by drive motor 158 and associated drive gear 154, and the fixture 150 is rotated so as to enhance cleaning of the parts. The wheel 132 is then rotated to the blow-off station by the drive motor 144. The fixture drive gear 154 is engaged with the endless belt 156 and the fixture 150 will be rotated at the blow-off station. Air (or like drying fluid) may be blown through the spray nozzles 125 to remove wash solution and dry the parts. The wheel 132 next is indexed to the load station, where the drive gear 154 is disengaged from the belt 156 and the fixture 150 does not rotate so as to enable removal of the cleaned parts from the fixture 150. As the wheel 132 is indexed from station to station, the parts in each fixture 150 are cleaned and dried.

Figure 4:
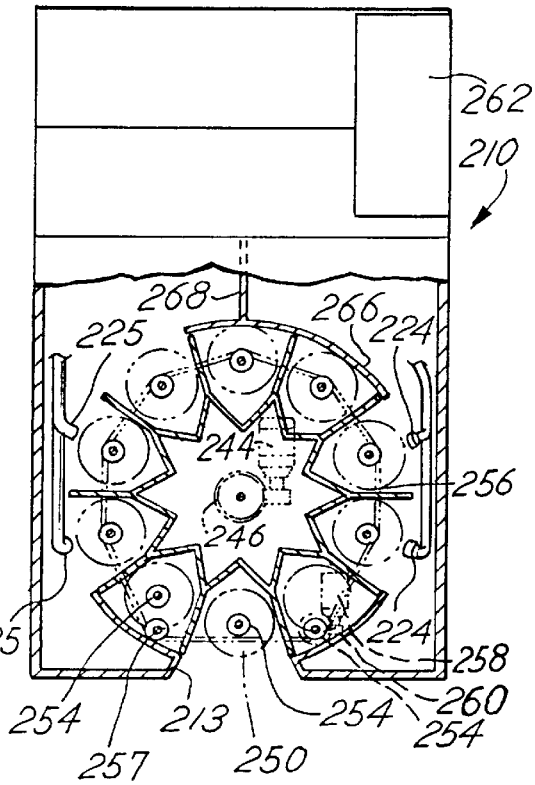
FIG. 4 is a schematic plan view, similar to FIG. 2, but illustrating an embodiment of a parts cleaning machine having a pocketed wheel carrying ten fixtures, and including a drain station in the housing.
Figure 5:
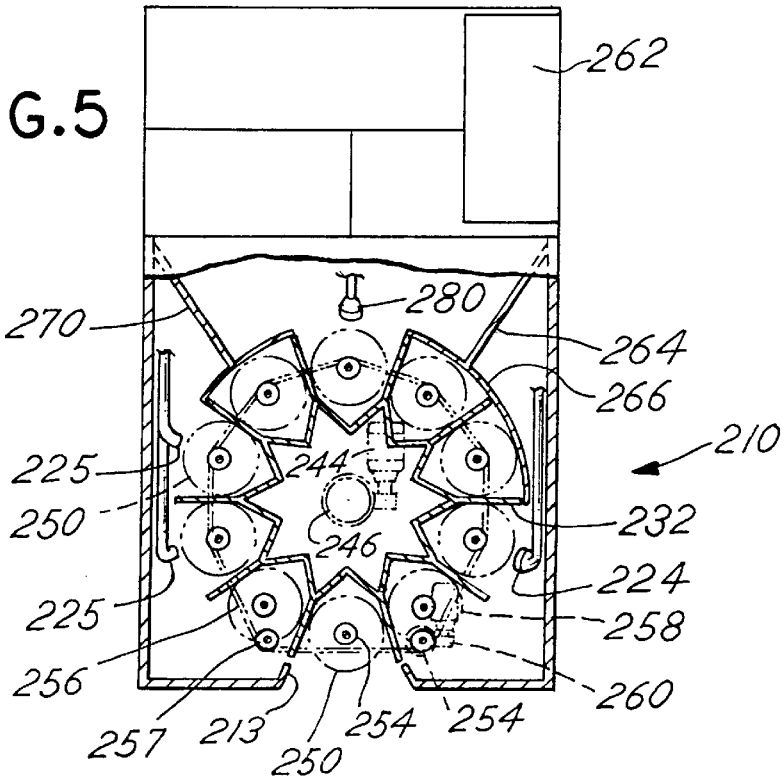
FIG. 5 is a schematic plan view, similar to FIG. 2, but illustrating an embodiment of a parts cleaning machine having a pocketed wheel carrying ten fixtures, and including both a rinse station and a drain station.
Figure 6:
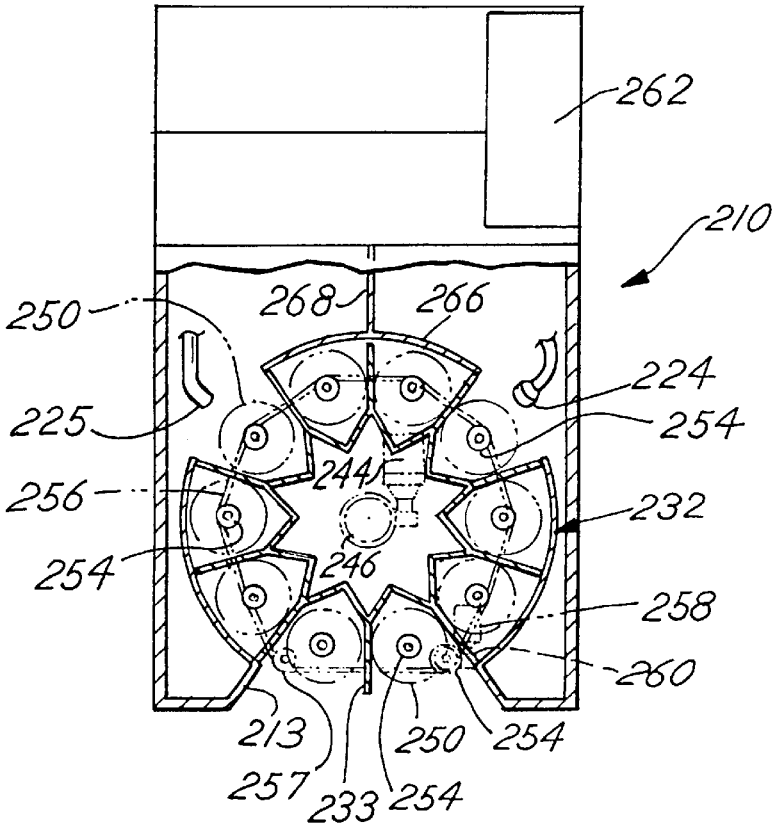
FIG. 6 is a schematic plan view, similar to FIG. 2, but illustrating an embodiment of a parts cleaning machine having a pocketed wheel carrying ten fixtures and a widened inlet opening in the housing to accommodate both a load station and an unload station.

FIGS. 4, 5, and 6 illustrate yet another embodiment of parts cleaning machine with ten pockets provided in the pocketed wheel. The parts cleaning machine 200 shown in FIGS. 4, 5, and 6 includes a pocketed wheel 232 with pockets 233 and with a fixture 250 in each of the pockets 233. The drive mechanism is substantially the same as that previously described, except that the endless belt 256 is trained over seven gears 254 and one idler gear 257, whereby three fixtures 250 are disengaged from the belt 256 and seven fixtures are driven by the belt 256 as the wheel 232 is indexed from position to position. Belt 256 is driven by fixture drive motor 258 and associated drive gear 254.

In the embodiment of FIG. 4, two arrays of spray nozzles 224 are provided to spray a wash liquid onto two fixtures 250 concurrently. Provided in the housing 212 are removable partition walls 266 and 268. In the region of the partition wall 266 wash solution can drain from the washed parts. One or more arrays of blow-off nozzles 225 are provided in the housing 212 to remove any liquid remaining on the cleaned parts after draining.

In the embodiment of FIG. 5, the partitions 264 and 270 are arranged somewhat differently from the partitions in the embodiment of FIG. 4. A rinse nozzle 280 is provided between the partitions 264 and 270. The rinse nozzle 280 may comprise an array of spray nozzles operatively connected to a tank of rinse solution in the housing 212. The single spray nozzle or array of spray nozzles 224 spray wash solution into one fixture at the wash station. As the wheel 232 is indexed, the fixture 250 containing the washed parts will move from the wash station and wash solution can drain from the cleaned parts. At the rinse station, spray nozzles 280 can spray rinse solution onto the cleaned parts. The blow-off nozzles 225 are adapted to blow off the remaining liquid from the cleaned parts in two cells or pockets 233 of the wheel 232.

In the embodiment of FIG. 6, the inlet opening 213 in the housing 212 is widened to permit access to two cells or pockets 233 of the wheel 232. The pocketed wheel 232 is indexed by the drive mechanism including wheel drive motor 244 from the load station to the wash station, where the spray nozzle 224 are positioned to spray wash solution into a single pocket 233. The pocketed wheel 232 is indexed to position a single pocket 233 at the blow-off station, where the remaining liquid can be blown from the cleaned parts by spray nozzle 225. The fixture drive mechanism in FIG. 6 is basically the same as the drive mechanism of FIGS. 4 and 5, except that the idler gears 257 are positioned such that at the load station the drive gears 254 of the two fixtures 250 positioned at the load station are disengaged from the belt 256, so that the fixtures 250 at the load station do not rotate to permit loading and unloading of parts to be cleaned into and out of the fixtures 250 at the load station. For example, parts to be cleaned can be loaded into the right fixture 250 at the load station as viewed in FIG. 6 and cleaned parts can be removed from the left fixture 250 at the load station as viewed in FIG. 6. The endless belt 256 is driven by fixture drive motor 258 and associated drive gear 254.

Figure 7:
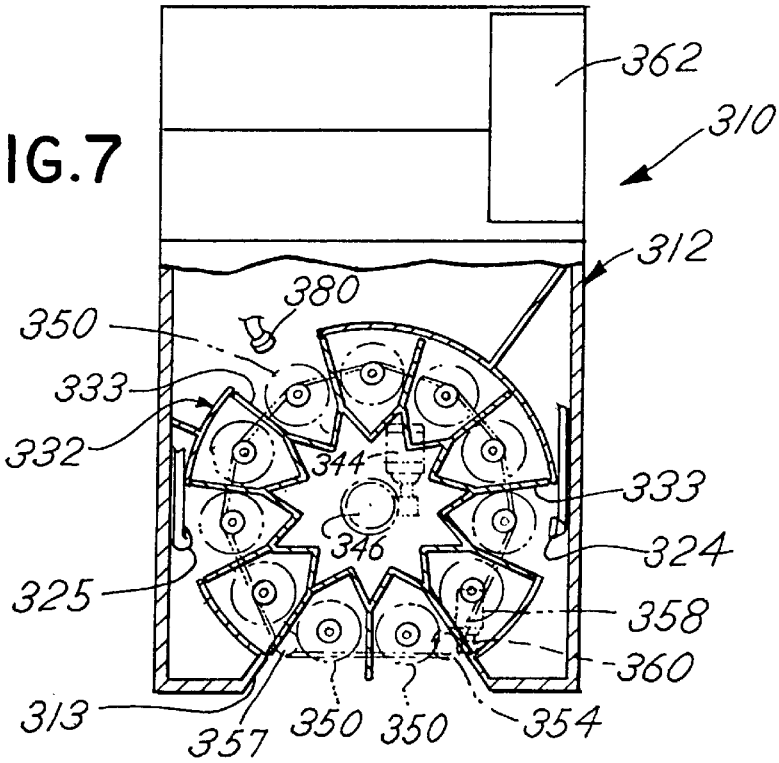
FIG. 7 is a schematic plan view similar to FIG. 2, but illustrating an embodiment of a cleaning machine having a pocketed wheel carrying eleven fixtures, with a widened inlet opening for accommodating both a load and an unload station, and including both a rinse station and a drain station in the housing.

Turning to FIG. 7, a modified parts cleaning machine 310 is provided with eleven pockets 333 in the pocketed wheel 332. The configuration is similar to the embodiment of FIG. 6 in that the inlet opening 313 in the housing 312 is widened to permit access to two fixtures 350 at the load station. As in FIG. 6, the right fixture 350 in FIG. 7 may be used to load parts to be cleaned and cleaned parts can be removed from the left fixture at the loading station. The parts cleaning machine 310 incorporates a wash station having spray nozzles 324 for spraying wash solution into a single cell or pocket 333 of the pocketed wheel 332, a rinse station where spray nozzles 380 can spray rinse solution into a single cell or pocket 333 of the pocketed wheel 332, and a blow-off station, where blow-off spray nozzles 325 are positioned to remove liquid from the cleaned parts in a single cell or pocket 333 to dry same.

The drive mechanism for the ten pocket parts cleaning machine 210 of FIG. 6 is substantially the same as the drive mechanism for the eleven pocket parts cleaning machine 310 of FIG. 7. A drive gear 354 associated with each fixture 350 is adapted to engage the endless belt 356. The idler gear 357 is positioned so that the drive gear 354 for the two fixtures 350 at the load station are not engaged with the belt 356. Thus, the two fixtures 350 at the load station are not rotated while at the load station. The pocketed wheel 332 is rotated by the wheel drive motor 344 while the endless belt 356 is drive by fixture drive motor 358 and associated drive gear 354.

The parts cleaning machine of the present invention is readily adaptable for a variety of configurations to suit the needs of selected users. The parts cleaning machine is compact, requires a minimum of floor space, and is relatively inexpensive to build and to operate.

While presently preferred embodiments of the present invention are illustrated above, it will be apparent to persons of skill in the art that the invention may be otherwise embodied without departing from the spirit and the scope of the appended claims.

What is claimed is:

1. A rotary parts cleaning machine comprising a housing defining a cleaning chamber having an inlet opening and a plurality of stations in said cleaning chamber including a load station and at least one wash station; a wash media source in fluid flow communication with the wash station; a generally vertically oriented shaft in the housing; a pocketed wheel mounted to the shaft for rotation about a generally vertical axis, a pocketed wheel drive operably associated with the shaft; at least one fixture situated in a pocket of the pocketed wheel, depending downwardly from the pocketed wheel and rotatable about a generally vertical axis spaced from the shaft while in the pocket, a fixture drive intermittently engageable with each fixture to rotate the same at a station other than the load station; and at least one spray nozzle at each wash station and in fluid communication with the wash media source.

2. A rotary parts cleaning machine as in claim 1, wherein the pocketed wheel drive and the fixture drive are disposed in a compartment separate from the cleaning chamber.

3. A parts cleaning machine comprising a housing defining a cleaning chamber with an inlet opening, a liquid tank for containing wash liquid disposed in the housing, generally vertically oriented shaft journalled in the housing, a pocketed wheel carried for rotation with the shaft in the chamber, at least one fixture constructed and arranged to carry parts to be cleaned, said fixture being rotatably carried in an upright orientation on the pocketed wheel, a pocketed wheel drive above the pocketed wheel for rotating the pocketed wheel, a fixture drive above the pocketed wheel for intermittently rotating the fixture about a generally vertical axis when at a predetermined station, said pocketed wheel drive and said fixture drive being disposed in a compartment above said chamber, at least one nozzle within the housing for washing parts in the fixture, and a drying gas source within the housing for drying washed parts in the fixture, whereby parts to be cleaned are received in the fixture through the inlet opening in the housing at a load station, the pocketed wheel is rotated to move the fixture to a wash station, the fixture is rotated at the wash station, the pocketed wheel is rotated to move the wheel through a drying station back to the load station, and the fixture is not rotating at the load station to permit clean parts to be removed from the fixture.

4. A parts cleaning machine as in claim 3, wherein the fixture has a drive gear thereon disposed in said compartment, the fixture drive further including an endless belt constructed and arranged to engage the drive gear on the fixture at a predetermined location for rotating the fixture at the predetermined location.

5. A parts cleaning machine as in claim 4, wherein the fixture includes a rod extending therefrom having a drive gear thereon operatively disposed in the compartment above the chamber, the endless belt constructed and arranged to engage the drive gear on the fixture at the predetermined location for rotating the fixture, the predetermined location being the wash station.

6. A parts cleaning machine as in claim 3, wherein the shaft has a gear thereon and the pocketed wheel drive includes a drive gear engaging the gear on the shaft means for driving same to rotate the wheel.

7. A parts cleaning machine as in claim 6, including a control for selectively actuating the pocketed wheel drive.

8. A parts cleaning machine as in claim 3, wherein the fixture comprises a foraminous basket for holding parts.

9. A parts cleaning machine as in claim 8, wherein at least one spray nozzle operatively connected to the tank for spraying wash liquid into the foraminous basket at the wash station.

10. A parts cleaning machine as in claim 8, including a tank containing rinse liquid and at least one spray nozzle operatively connected to the tank containing the rinse liquid for spraying rinse liquid into the foraminous basket.

11. A parts cleaning machine as in claim 3, including a drying gas source for introducing a drying gas over cleaned parts to dry same.

12. A parts cleaning machine as in claim 3, wherein the pocketed wheel has at least one pocket, with the fixture being rotatable in said pocket.

13. A parts cleaning machine as in claim 3, wherein the wheel has at least three pockets, with a fixture being rotatable in each pocket.

14. A parts cleaning machine as in claim 3, wherein the wheel has at least ten pockets, with a fixture being rotatable in each pocket, the fixture having a gear thereon engaged with the fixture drive, except in the region of the load station, whereby the fixtures are disengaged from the fixture drive at the load station and are stationary.

15. A parts cleaning machine as in claim 14, wherein the inlet opening is constructed and arranged to accommodate two pockets of the pocketed wheel to permit access to two fixtures for loading of one fixture while unloading of the second fixture.

16. A parts cleaning machine as in claim 3, wherein the wheel has eleven pockets, with a fixture being rotatable in each pocket, the fixtures each having a gear thereon engaged with the fixture drive, except in the region of the load station, whereby the fixtures are disengaged from the fixture drive at the load station and are stationary.

17. A drive mechanism for a parts cleaning machine including a wheel mounted on a generally vertical shaft for rotation about a generally vertical axis, and at least one fixture carried on the wheel for rotation about a vertical axis, said drive mechanism including a wheel drive operatively connected to the wheel and a fixture drive operatively connected to the fixture for rotating same, the wheel having a gear, the wheel drive including a drive gear for engaging the gear on the wheel for rotating the wheel, the fixture having a gear, and the fixture drive including an endless belt constructed and arranged to engage the gear on the fixture for rotating the fixture when the gear on the fixture is engaged with the endless belt.

18. A drive mechanism as in claim 17, including a control for selectively actuating the wheel drive and the fixture drive.

19. A drive mechanism as in claim 17, wherein the endless belt is trained over a plurality of idler gears which are constructed and arranged to disengage the endless belt from the gear on the fixture at a predetermined location of the fixture.

20. A drive mechanism as in claim 17, including a plurality of fixtures on the wheel, each fixture having a gear at the upper end thereof constructed and arranged to engage the endless belt so as to be driven thereby.

21. A drive mechanism as in claim 17, wherein the wheel drive and the fixture drives each have a separate motor.

22. A drive mechanism as in claim 17, wherein the wheel drive and the fixture drive are both actuated by the same motor.

* * * * *